US006612399B1

(12) United States Patent
Corsaro

(10) Patent No.: US 6,612,399 B1
(45) Date of Patent: Sep. 2, 2003

(54) LIGHTWEIGHT LOW FREQUENCY LOUDSPEAKER FOR ACTIVE NOISE CONTROL

(75) Inventor: Robert D. Corsaro, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 111 days.

(21) Appl. No.: 09/796,680

(22) Filed: Mar. 2, 2001

(51) Int. Cl.[7] ..... G10K 13/00
(52) U.S. Cl. ..... 181/171; 181/172; 181/173
(58) Field of Search ..... 181/167, 169, 181/171, 172, 173; 381/71.1

(56) References Cited

U.S. PATENT DOCUMENTS

| | | | | |
|---|---|---|---|---|
| 5,251,188 A | | 10/1993 | Parsons et al. | 367/140 |
| 5,744,761 A | | 4/1998 | Ogura et al. | 181/167 |
| 5,748,759 A | * | 5/1998 | Croft et al. | 181/171 |
| 6,219,432 B1 | * | 4/2001 | Fryer et al. | 181/171 |
| 6,478,109 B1 | * | 11/2002 | Kam | 181/177 |

* cited by examiner

*Primary Examiner*—Khanh Dang
(74) *Attorney, Agent, or Firm*—Laurence G. Legg; John J. Karasek

(57) ABSTRACT

The invention described herein is a low-mass, light-weight sound generator with particularly good performance at mid and low audio frequencies. It is expected to find principal use in applications where mass is of crucial importance. It is capable of delivering the high acoustic levels, as required for sound generation or active sound control. The present invention uses a generally planar acoustic membrane as a diaphragm, the diaphragm being in tension and attached at its outer edge to a support frame which provides a soft boundary condition to the acoustic diaphram.

In a preferred embodiment, the support structure is an inflatable toroidal tube of rubber or rubber-like material. A polymer membrane is attached to the support structure by heat sealing the membrane in place. A voltage is applied to a piezoelectric bender-type actuator, which imparts axial displacement to a region of the diaphragm, causing resonance of the diaphragm in the desired frequency range.

21 Claims, 13 Drawing Sheets

(2 of 13 Drawing Sheet(s) Filed in Color)

64.067 hz 68.97 hz

65 Hz - (3, 1) plate mode 122.681 hz 127.563 hz 132.446 hz

128 Hz - (1, 3) plate mode 161.743 hz 166.626 hz 171.509 hz

166 Hz - (4, 1) plate mode

APPARENT MODES - DRIVEN BY BENDING OF TUBE

Data is for Relative Displacement Phase 64.087 hz 66.97 hz

~65 Hz - (3, 1) plate mode?

122.881 hz 127.563 hz 132.446 hz

~128 Hz - (1, 3) plate mode?

161.743 hz 166.626 hz 171.509 hz

~166 Hz - (4, 1) plate mode?

LIGHTWEIGHT LOW FREQUENCY LOUDSPEAKER FOR ACTIVE NOISE CONTROL

BACKGROUND OF THE INVENTION

1. Field of the Invention

The present invention relates to diaphragms for acoustic speakers or transducers, and more specifically, to diaphragms coupled to lightweight supports that impose soft boundary conditions on the diaphragm.

2. Description of the Prior Art

Many lightweight audio sound generators or loudspeakers provide good performance at high frequencies. Low frequency loudspeakers generally are large and heavy, and require high power inputs.

In extremely noisy areas, low frequency sound generation is needed to reduce the overall noise level by application of anti-noise (sound applied 180 degrees out of phase). In space launch vehicles, for example, the preferred method for absorbing the high sound pressure level low frequency noise in the payload fairing area is to include thick aluminum plates in the structure itself. If a lightweight low-frequency sound generator were available for active noise control, these heavy fairings could be replaced by much lighter structures with only enough mass for structural support. Clearly, other vehicles (aircraft, ground vehicles, and ships) and other noisy machinery applications could also benefit from the availability of lightweight sound generators.

The typical low-frequency audio sound generator (i.e. loudspeaker) consists of two key components: an actuator and a diaphragm. In the typical loudspeaker the actuator, which transforms the input electrical energy into displacement and force, is an electromagnetic voice coil. The displacement generated by the actuator is applied to the vibrating diaphragm or cone, which acts as a mechanical lever or piston to increase the volume displacement and hence increase the efficiency of radiation. In order to produce high output at low frequencies, the voice coils must be of relatively high mass. In aerospace applications where weight is a crucial expense, the use of such loudspeakers can become prohibitive. Other sound generators have been devised, but all have serious limitations on their range of applicability. Horn and buzzer type actuators can be designed which are light-weight and capable of low frequency use, however their narrow-band nature and poor controllability limits their use to a narrow range of applications.

One approach to reducing mass in a conventional loudspeaker design has been to use lower-mass actuators than the electromagnetic voice coil. Alternative lower-mass actuators exist, such as piezoelectric monomorphs and bimorphs. These actuators can deliver reasonable displacement, but in previous configurations when coupled to conventional diaphragms in air they have failed to produce the combination of force and displacement needed at low frequencies.

Polymer speakers have been successful in high frequency applications, but have not been capable of delivering the high displacement levels required for low frequency use.

One novel method for producing low frequency acoustic vibrations in air using a polymer acoustic diaphragm is discussed in U.S. patent application Ser. No. 60/208,323, filed on Jun. 1, 2000.

These loudspeakers share similar simple boundary conditions at the edge of the diaphragm—the diaphragm typically is either simply supported (i.e. a drum head) or attempts to approach the free boundary condition (i.e. a piston).

The limitations of current acoustic technology are illustrated by the standard equations are available in textbooks for sound radiation from sources. For a piston source a surface displacement $\Delta x$ will generate a sound pressure given by $P=2\pi f Z \Delta x G(S)$, where P is the sound pressure level, Z is the appropriate acoustic impedance, and G(S) is the function of the separation distance. The acoustic impedance Z can be written as $Z=\rho_{air}c_{air}$, where $\rho_{air}$ is the density and $C_{air}$ is speed of sound in the air surrounding the membrane. The sound pressure level in air can therefore be expressed as:

$$SPL = 20\mathrm{Log}\left(\frac{2\pi\rho_{air}c_{air}\Delta x G(S)}{20\mu\mathrm{Pa}}\right) \quad \text{Equation (1)}$$

where 20 $\mu$pa ($20\times10^{-6}$ Pascals) is the standard reference pressure used for air. The G(S) term in Equation (1) is defined as $$G(S) = 2\sin\left\{\frac{\pi S}{\lambda}\left[\sqrt{\left(\left(\frac{a}{S}\right)^2+1\right)}-1\right]\right., \quad \text{Equation (2)}$$

where $\lambda$ is the wavelength, a is the radius of the piston source or membrane, and the separation distance S is the axial distance from the membrane to the point at which the sound pressure level is calculated or measured.

Equation (2) is applicable only to the pressure on the axis of a disk array, and contains nulls and reinforcements not experienced at off-axis locations. An alternative expression which ignores the local nulls particular to the on-axis response can be obtained by using the simple farfield distance dependence:

$$G(S) = \frac{A}{\lambda S} \quad (3)$$

where A is the array area (cross sectional area of the piston).

The acoustic impedance Z of Equation (1) is typically the real part of the radiation impedance, which results in the net radiated energy. Alternatively, if the result desired is an envelope of the axial response, then the value used for Z in Equation (1) is twice the magnitude of the total radiation impedance. One expression for the radiation impedance is:

$$Z(X) = \left(1-\frac{2J_1(X)}{X}\right)+i\left(\frac{2H_1(X)}{X}\right) \quad \text{Equation (4)}$$

were $J_1$ is the first order Bessel function, $H_1$ is the first order Struve function (a well known mathematical function in acoustics), and $X=2\pi a/\lambda$.

To illustrate the characteristics of currently available loudspeakers, FIG. 1 compares the calculated values for the generated sound pressure level along the axis of a 28 cm diameter circular membrane clamped at its peripheral edge (resembling the behavior of a piston type source). The conditions used are for nominally 1 micron displacement, with an axial measurement of sound pressure level at a separation distance of 25 cm from the face. At frequencies below 1.5 kHz, the distance of 25 cm is in the acoustic farfield of the radiator.

FIG. 1 illustrates that while the source level (sound pressure level) is very large at medium to high frequencies, it falls off rapidly at low frequencies. To achieve high sound pressure levels at frequencies below 200 Hz for pistons or conventionally clamped diaphragms, one must use much larger displacements than the one micron value used above. In order to produce the required greater displacements, stiffer and more massive diaphragms, higher input energies and higher actuator force levels are necessary.

Conventional loudspeakers rely on the stiff frame (to which the diaphragm is attached) to ensure that the dynamic force opposing the axial displacement of the diaphragm is contributed primarily by the membrane, rather than by the frame. The tension, edge compliance, and material properties of the membrane are critical to good performance. The tension must generally be even all around to produce a reasonably uniform sound output at low frequencies. Additionally, some conventional membrane-based acoustic projectors must be adjusted at frequent intervals to ensure that the tension does not drop too low.

In order to illustrate the advantages of the present invention compared to conventional loudspeakers, a loudspeaker was fabricated using a polymer acoustic membrane as a diaphragm, and the peripheral edge was clamped to a stiff circular frame, (28 cm in diameter). A "Thunder" type piezoelectric monomorph bender actuator was attached to the diaphragm-frame assembly, and located so a free end of the bender actuator was in contact with a face of the diaphragm. As a voltage was applied to the actuator, the actuator bent proportionately to the applied voltage, moving the free end of the piezoelectric actuator axially, and deflected the diaphragm surface in an axial direction.

FIG. 2 illustrates the sound pressure levels measured using a calibrated microphone at a point 25 centimeters above the center of the diaphragm. In this test, the applied voltage was 200 volts. FIG. 4 also plots the predicted sound pressure level for an ideal piston source based on a one micron piston displacement and 200 volts peak.

Projectors with acoustic membranes having clamped-edge boundary conditions of similar size for various materials in various frames will exhibit behavior similar to that shown in FIG. 2. Below 150 Hz the performance typically decreases with a slope of 40 to 60 dB per decade. Performance above 150 Hz typically approaches a relatively constant SPL value (85 to 95 dB for the example shown in FIG. 2 at 200 V drive and 25 cm distance), presumably due to either the system reaching a dense wavenumber distribution region and/or a force-limited condition. The mounting arrangement and diaphragm tension may be adjusted to introduce some resonant behavior in the low frequency region, however these contributions are typically small and often degrade performance in nearby frequency bands, reducing broadband performance.

It is apparent that none of the current loudspeakers meet the need for lightweight acoustic projectors with good low frequency performance in air. These are particularly needed for active noise control systems.

SUMMARY OF THE INVENTION

An object of the invention is to provide a lightweight loudspeaker with good low frequency sound pressure levels.

An object of the invention is to provide a lightweight loudspeaker which produces broadband performance over mid and low frequencies.

Another object of the invention is provide an acoustic projector for use in active control systems.

The invention described herein is a low-mass, lightweight sound generator with particularly good performance at mid and low audio frequencies. It is expected to find principal use in applications where mass is of crucial importance. It is capable of delivering the high acoustic levels, as required for sound generation or active sound control. The present invention uses a generally planar acoustic membrane as a diaphragm, the diaphragm being in tension and attached at its outer edge to a support frame which provides a soft boundary condition to the acoustic diaphragm. Preferably, an actuator transmits axial displacement to the acoustic diaphragm in response to an applied voltage, thereby exciting resonances in the diaphragm and generating high sound pressure levels in the air in front of the diaphragm.

BRIEF DESCRIPTION OF THE DRAWINGS:

The file of this patent contains at least one drawing executed in color. Copies of this patent with color drawings will be provided by the Patent and Trademark Office upon request and payment of the necessary fee.

Figure 1:
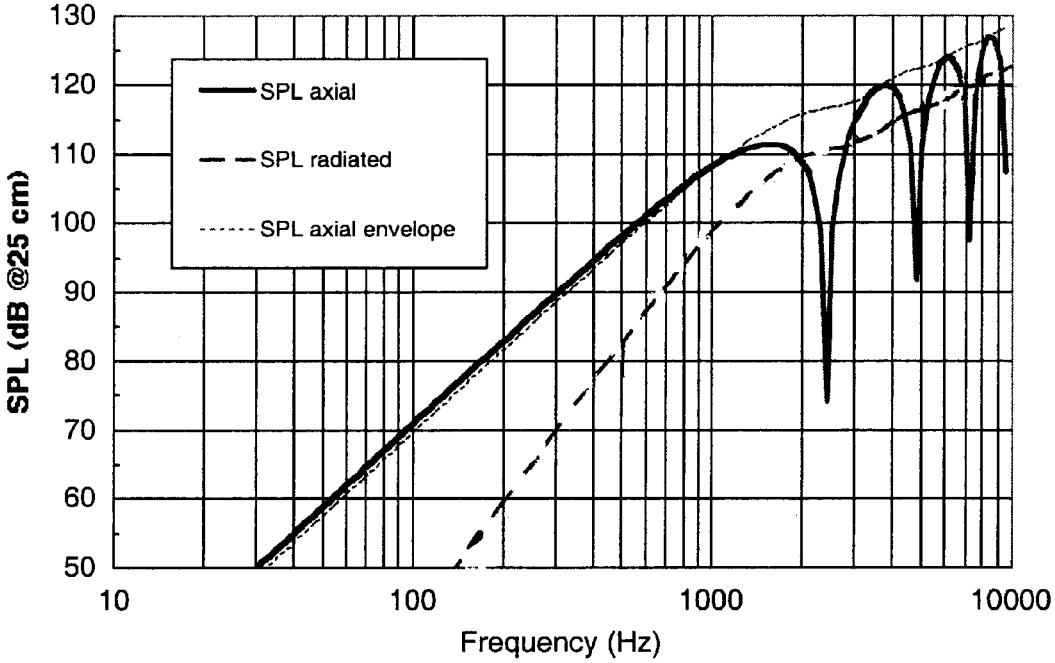
FIG 1 PRIOR ART
FIG. 1 is a graph illustrating predicted sound pressure level for prior art loudspeakers.
Figure 2:
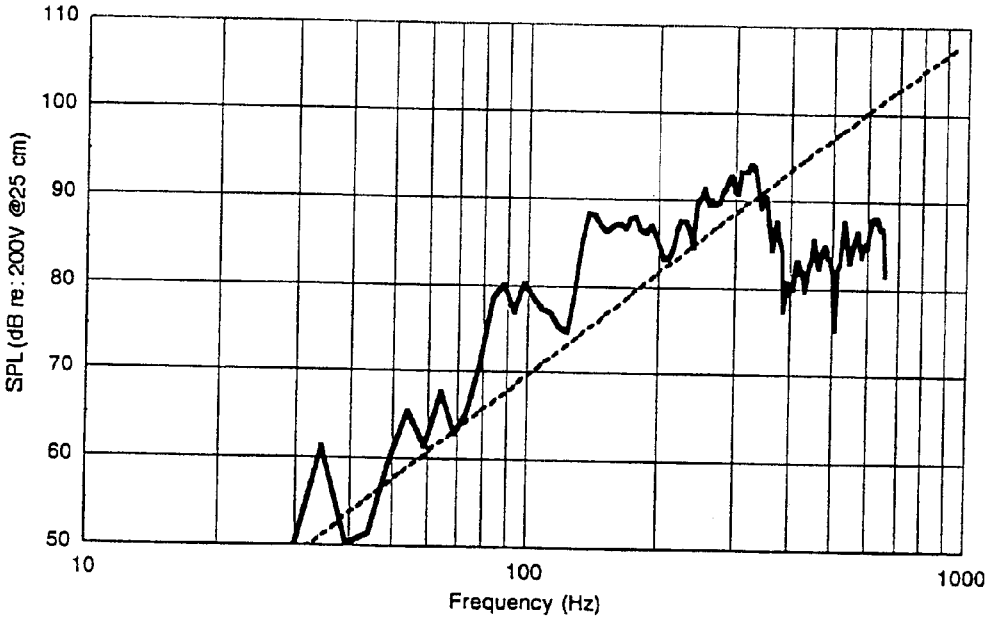
FIG 2 PRIOR ART
FIG. 2 is graph illustrating test results of sound pressure level versus frequency for prior art membrane loudspeakers.
Figure 3:
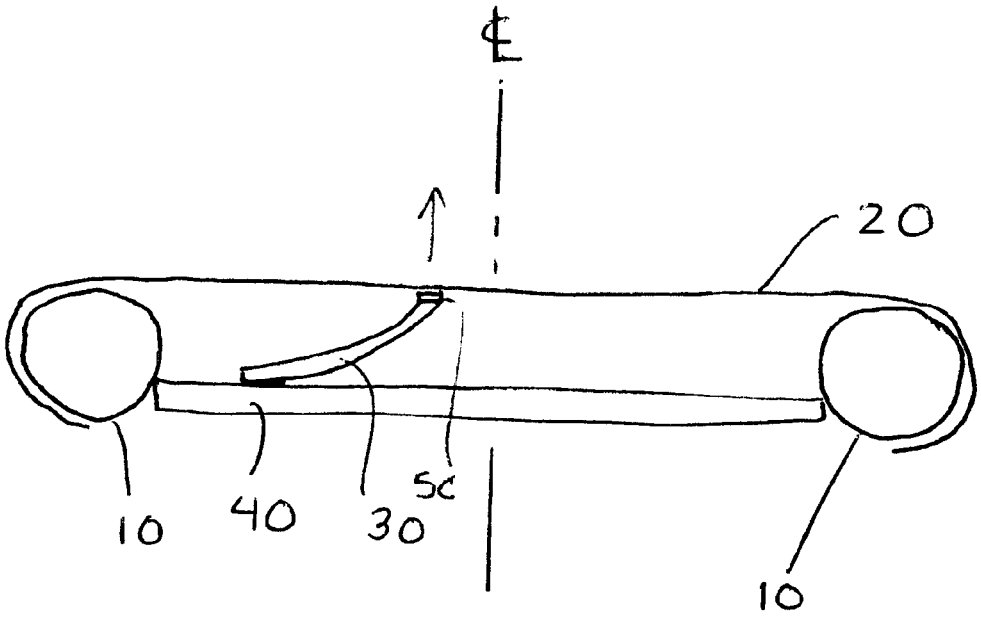
FIG. 3 is a cut away view of an embodiment of the invention.

DETAILED DESCRIPTION:

Refer first to FIG. 3, a cross sectional view which illustrates a preferred embodiment of the invention. A toroidally shaped support structure 10, shown herein as an inflatable rubber tube, is used as a frame for an acoustic diaphragm 20. The acoustic diaphragm 20 extends over the toroidally shaped support structure, and is stretched over the support structure 10, so the acoustic diaphragm 10 is in tension.

A piezoelectric bender-type actuator 30 is located so that one end is in contact with one side of the diaphragm 20. As shown in FIG. 3, the actuator 30 includes a cushion 50 at the end nearest the diaphragm 20 to reduce the point load on the diaphragm 20 and to reduce the likelihood of tearing the diaphragm 20. The other end of the actuator 30 is fixed to a rigid surface 40 which holds that actuator end in a fixed position. When a voltage is applied to the actuator 30, the end of the actuator 30 in contact with the diaphragm 20 deforms the diaphragm surface in the axial direction. The surface displacement of the diaphragm 20 generates a sound pressure in the air above the diaphragm 20.

Figure 4:
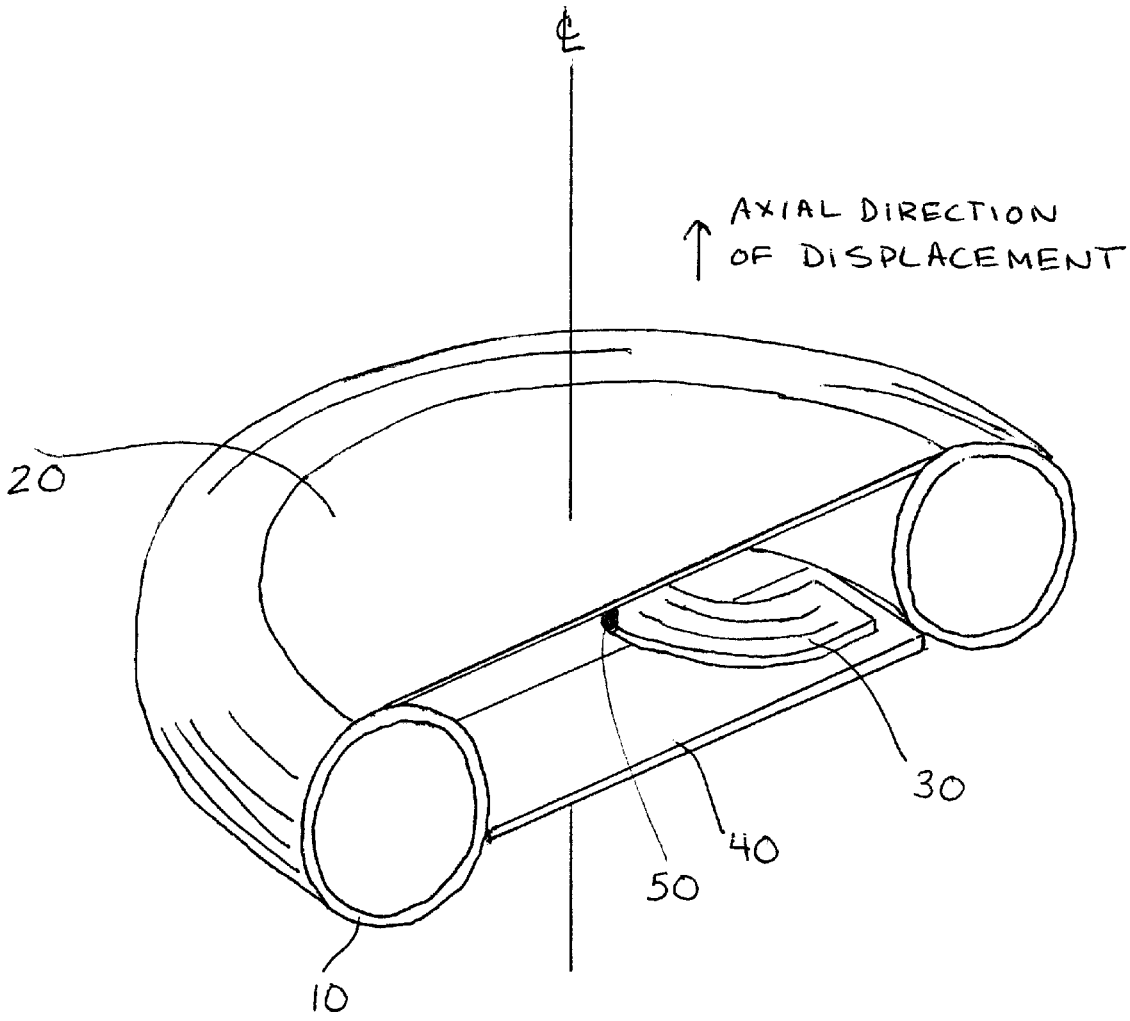
FIG. 4 is a cross sectional view of an embodiment of the invention.

FIG. 4 illustrates a cut away of this embodiment of the invention. In order to achieve good low frequency sound pressure levels, the support structure is chosen to be soft compared to the stiffness of the diaphragm. The softer support structure results in a softer boundary condition on the diaphragm edge compared to stiff support structures with clamped diaphragm. The softer boundary conditions lowers the fundamental mode of the diaphragm. As a result, application of a given actuator force will result in higher diaphragm surface displacement (and sound pressure levels) at lower frequencies.

Because the support structure 10 appears softer than the stretching stiffness of the diaphragm 20, the dynamic force opposing the diaphragm displacement is contributed primarily by the support structure 10, and is relatively low. This encourages low frequency modes in the diaphragm-tube assembly. As a result, even low-force actuators, such as the simple piezoelectric bi-laminate benders used for an actuator 30, can be used to deliver high sound levels at low frequencies.

As shown in FIGS. 3 and 4, the actuator 30 is preferably offset by a radial distance from the center of the diaphragm 20. In order to increase the maximum displacement of the center of the diaphragm while in a resonant mode, the actuator is typically located so that it touches the diaphragm at a point between the center and the edge of the diaphragm.

It will be apparent that many embodiments of this invention are possible.

The diaphragm material should be selected which has properties which will optimize performance. If the diaphragm 20 is too compliant or too massive, when the actuator 30 is displaced and is in contact with the diaphragm 20, the diaphragm 20 will simply bend over a small region near the actuation location, instead of resonating. This would result in a small total dynamic volume displacement, and very low acoustic efficiency. For the approach used here, the diaphragm 20 itself can be considered reasonably inelastic. The effective out-of-plane stiffness of the diaphragm 20 is increased considerably by applying tension on its support edge, in a manner analogous to the tension on a drum head. However, unlike a conventional drum head, the tension in this case is applied while maintaining a boundary condition which is dynamically soft. The fundamental mode of the diaphragm is then highly dependent on the dynamic stiffness or restoring force available at its outer edge. This results in modes which are considerably lower than those of a similar size acoustic diaphragm clamped to a rigid support (piston source or rigidly mounted drum head). Polymers such as Mylar (polyethylene terephthalate), polyethylene, kaptan, and polystyrene are examples of materials which were found to make effective acoustic diaphragms 20 for the present invention.

A related factor is the input point impedance of the diaphragm 20, which defines the force required by the actuator 30 to move the diaphragm 20. Therefore, in selecting an actuator/diaphragm combination to optimize performance, one should consider both the force and displacement characteristics of the actuator, and the diaphragm point impedance to ensure they work well together.

The dynamics of the support structure 10 also may affect the performance of the diaphragm. Because the inflatable rubber tube used as the support structure 10 of FIG. 3 and 4 has very little stiffness in the circumferential direction, it may twist in response to the flexural modes of diaphragm, thus exhibiting low frequency bending modes that drive the diaphragm, thus enhancing the diaphragm's sound radiation over select frequency bands. Conversely, these bending modes may degrade the sound performance at other frequency bands. Examples of this will be shown in later Figures.

In one embodiment, a prototype acoustic projector was fabricated by placing an inflatable rubber bicycle tube (labeled as 12 inch nominal diameter) in a polyethylene polymer bag and heat sealing the edges of the bag. The back face of the bag was then partially cut away and removed, leaving sufficient polymer material about the periphery and back of the tube to hold the polymer in place. The tube was partially inflated by introducing air into the tube, stretching the polymer membrane until a good tension was achieved. When inflated, the outer diameter of this diaphragm-tube-actuator assembly was 11 inches. A very stiff low-mass board (Hexcel Corp. honeycomb core with graphite facing) was attached to the tube on inner radial area of the tube away from the diaphragm, and the board was cemented to one end (the "fixed end") of a piezoelectric bending-type actuator (Thunder Model TH6R from Face International Corp.). The other end of the actuator (the "free end") was pressed against a face of the polymer membrane (via a felt layer to reduce loading) as shown in FIGS. 3 and 4.

If such a bender type cantilever peizoelectric actuator is employed, the fixed end of the actuator optimally should be sufficiently anchored, as to a stiff low mass board above, so that that the driven displacement/force applied by the actuator is not reduced or lost at this boundary.

One advantage of using an inflatable toroidal rubber or rubber-like tube as a support structure is that the tension in the acoustic diaphragm may be easily adjusted by adding more or less air to the tube. If the acoustic membrane exhibits creep over time, the tension in the diaphragm is maintained by the air pressure in the tube.

Figure 5:
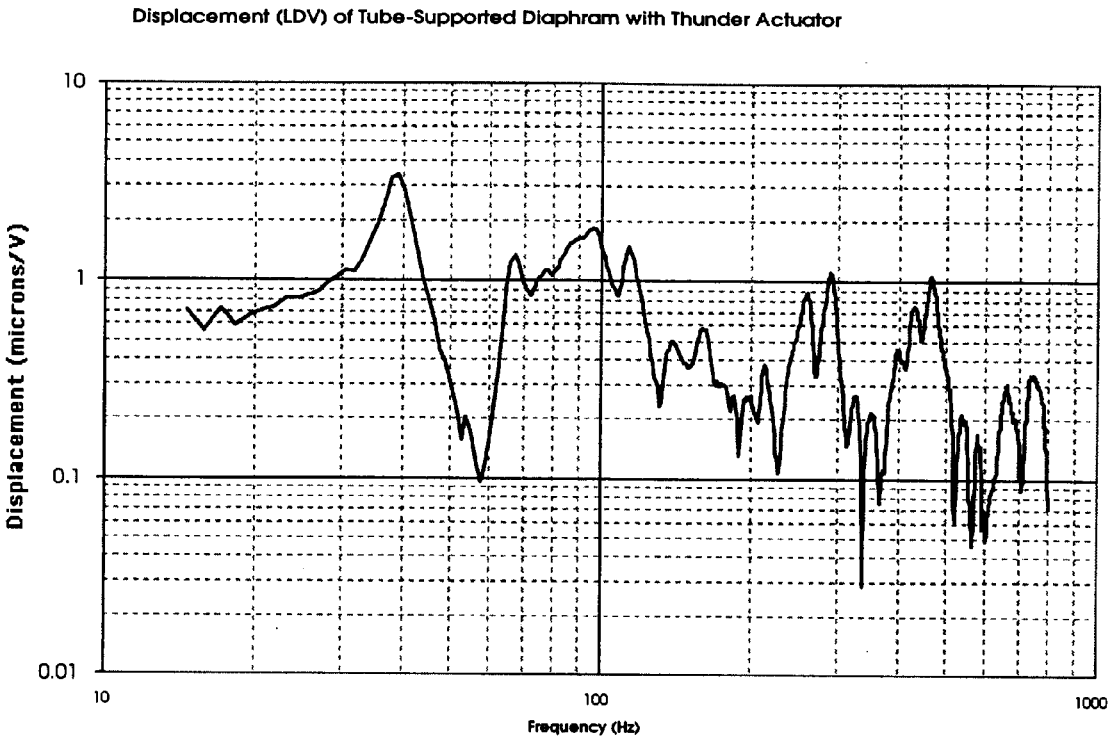
FIG. 5 is a graph of the test results (displacement versus frequency) for an embodiment of the invention.

FIG. 5 is a graph illustrating the results of laser Doppler vibrometry (LDV) measurements of surface displacement of the diaphragm. For this test, 200 volts peak were applied to the piezoelectric actuator. The LDV was located 25 cm from the center of the diaphragm in an axial direction. As shown in FIG. 5 and in the surface displacement map of FIG. 7, at about 40 Hz, a maximum displacement of 3.35 microns per volt (−109.5 dB re 1 m/V) was measured. The high displacement at 40 Hz is due to the presence of a fundamental structural mode at this frequency. As shown in FIG. 5, this projector also has good broad band displacement: at frequencies below 500 Hz the measured diaphragm surface displacement was usually in the range of 0.2 to 1 micron per volt. The maximum displacement of 3.35 microns per volt measured at 40 Hz is approximately twice as large as the Thunder piezoelectric actuator manufacturer's listed value of 1.6 microns per volt at no-load conditions. Since the piezoelectric actuator is rated for 900 volts maximum drive, and only 200 volts were applied in this test, this acoustic projector has the potential to deliver 4.5 times greater displacements than those shown in FIG. 5.

Figure 6:
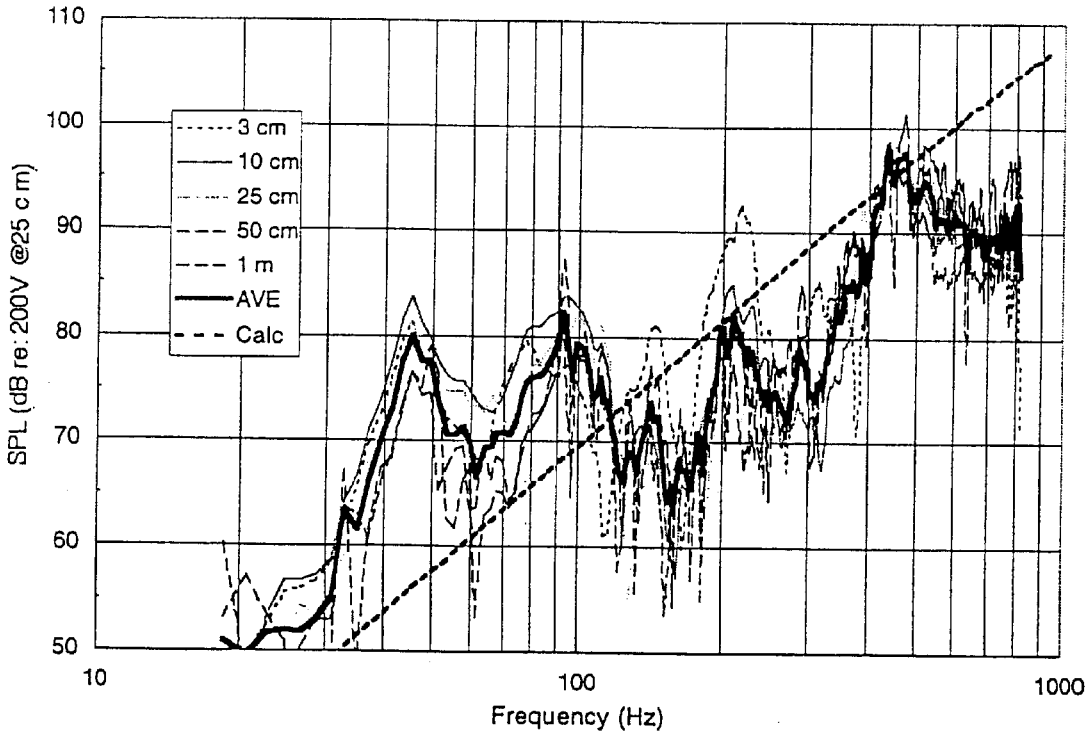
FIG. 6 is a graph of the test results (sound pressure level versus frequency) for an embodiment of the invention.

Note that in order to avoid undesired high-Q resonance of the piezoelectric actuator, the fundamental mode of the actuator itself can be avoided by insuring that the length of the piezoelectric bender actuator element is smaller than the first flexural mode in the actuator material. The first mode of the Thunder actuator element used in the acoustic projector of FIG. 6 is in the range 2.8 to 4.2 kHz, depending on the mounting conditions. Since this high-Q resonance occurs at frequencies well above the preferred low frequency operating range, it is not of concern for this example.

Additional test results for this embodiment are shown in FIG. 6. Sound pressure levels were measured using a calibrated microphone in the distant farfield of the projector, at an axial distance from the diaphragm. Again, 200 V peak was applied, and SPL measurements were taken at various microphone separation distances. These measurements were normalized to 25 cm using the inverse distance dependence given in Eq. 3 (i.e. in the acoustic farfield region, moving to half the separation distance caused a 6 dB increase the SPL).

In FIG. 6, the constant-slope dotted line labeled "Calc" is the displacement which would be expected for a dynamic displacement of 1 micron on a piston source the same size as the tube. This is the displacement which would be expected for a conventional clamped membrane with similar material properties and similar diaphragm diameter. The measured sound pressure levels were generally higher than the expected line, and they illustrate the advantages of the present invention. At low frequencies the radiation efficiency is much greater than expected from displacement alone, which is typical of the behavior expected during the excitation of one or more structural modes. In particular there is a 25 dB improvement at the fundamental resonance frequency of 45 Hz, and approximately a 10 dB improvement from 30 to 100 Hz. At high frequencies (particularly above 500 Hz) the output is somewhat less than expected, indicating either the onset of the force-limiting region of the actuator or the presence of non-radiating (flexural) modes.

At the piezoelectric actuator manufacturer's recommended maximum drive level (900 volts), the SPL should increase by an additional 13 dB.

The frequency variations in the sound pressure levels show in FIG. 6 are consistent with the variations in the surface displacements of FIG. 5. At the fundamental resonance frequency of 45 Hz (FIG. 6) and at the second resonance near 100 Hz, the SPL measured was approximately 80 dB (at 200 V and 25 cm distance). Overall the SPL is nominally 74±6 dB over the band from 38 to 330 Hz. Above about 330 Hz the output increases to a steady value of about 90 dB to at least 2 kHz. The difference in fundamental frequency (about 40 Hz for FIG. 5 and about 45 Hz for FIG. 6) is probably due to variations in the tube pressure as well as the different methods of supporting the acoustic projector during testing. For the displacement measurement of FIG. 5, the acoustic projector was laid flat, while for the SPL measurement of FIG. 6, the acoustic projector was suspended vertically.

From the geometry and operating principle sound radiation is expected to occur in both forward and backward directions away from the surface of the diaphragm. Sound pressure levels were measured from both the front and back of the acoustic diaphragm, and the SPL measurements from the front and back faces are found to be essentially identical, but 180° out of phase, as expected.

Figure 7:
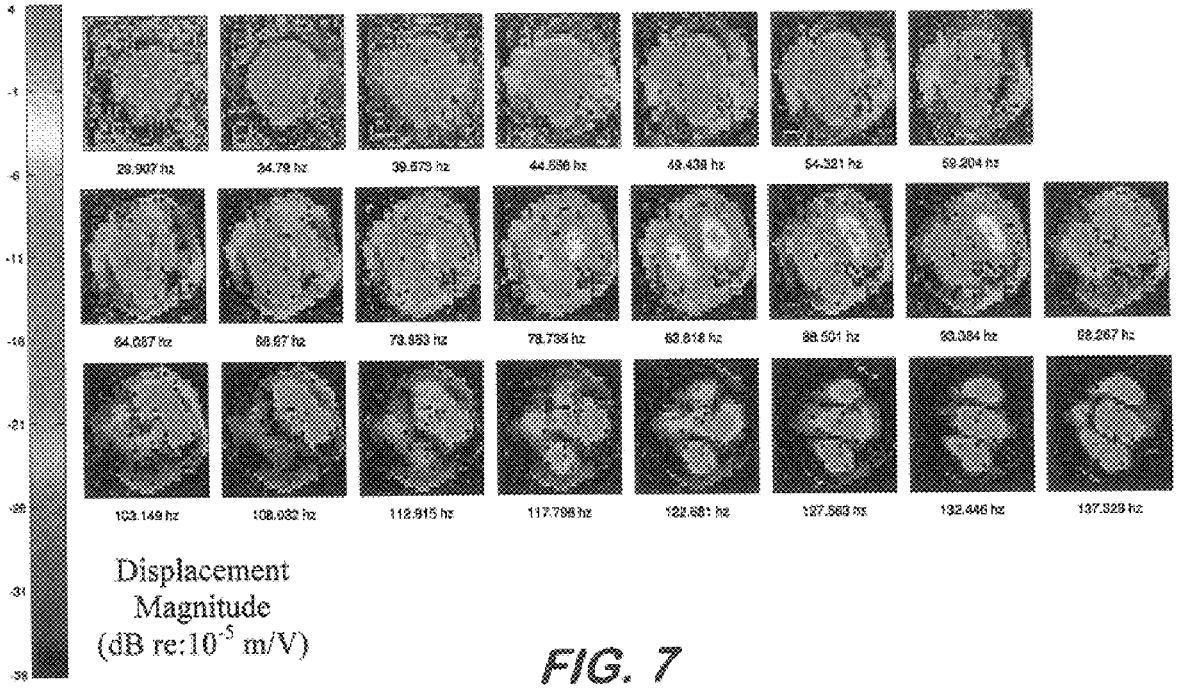
FIG. 7 is a color series of surface displacement maps for an embodiment of the invention over a frequency range.
Figure 8:
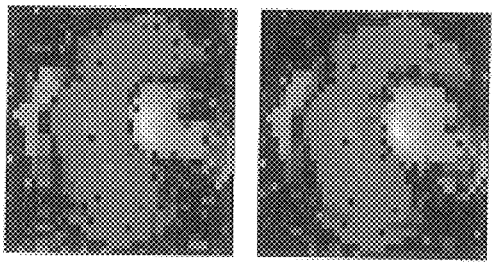
FIG. 8 is another color series of surface displacement maps illustrating the effects of flexural motion of the support ring on diaphragm surface displacement. another black and white series of surface displacement maps for an embodiment of the invention corresponding to FIG. 7.
Figure 8:
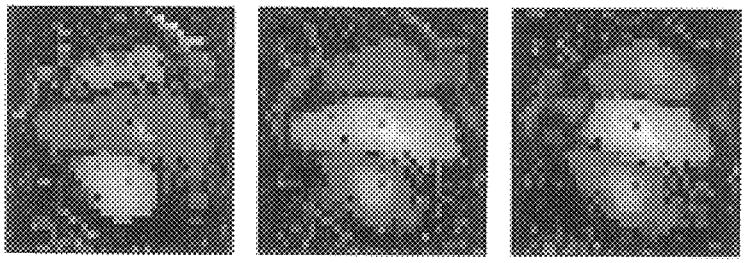
Figure 8:
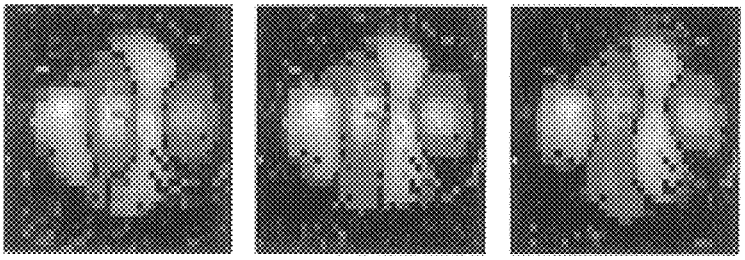
Figure 9:
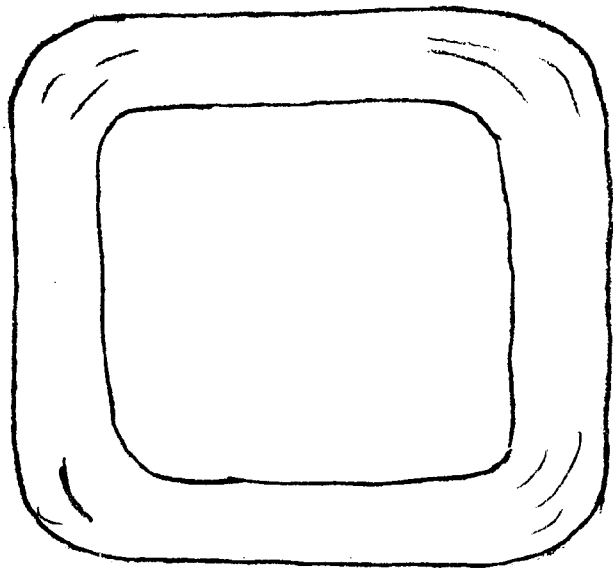
FIG. 9 is an embodiment of a square support structure for use in an embodiment of the invention.

FIGS. 7 and 8 are surface displacement maps measured with LDV apparatus for the acoustic projector of FIGS. 5 and 6. FIGS. 7 and 8 show the surface displacement at different points on the acoustic diaphragm, and show the relative phase of the motion as a function of frequency.

FIGS. 7 and 8 also illustrate both diaphragm and support modes which are present in the acoustic projector. The diaphragm modes are membrane modes, seen for example in FIG. 7 as a 0,1 mode at about 35 Hz, a 0,2 mode at 53 Hz, a 1,1 mode at about 85 Hz, and a 3,1 mode at about 175 Hz. In addition, other modes in the support tube drive the diaphragm in a manner that mimics a plate mode. See, for example, FIG. 8, for an illustration of diaphragm motion that mimics a 3,1 plate mode at about 65 Hz, a 1,3 plate mode at about 128 Hz, and a 4,1 plate mode at about 166 Hz. The plate-like modes are the result of twisting in the support structure. The determination of the frequencies at which these fundamental membrane and plate-like modes occur is made by comparing the contours of these surface displacement maps with classical contours for plate and membrane modes. Other vibrational characteristics will be apparent to those of skill in the acoustic arts.

Selection of the support structure may be accomplished to emphasize or reduce these modes, depending on the desired performance range. If the plate-like modes shown in FIG. 8 are not acceptable, a different support structure, which provides soft diaphragm boundary conditions without plate flexural modes, should be used.

Figure 10:
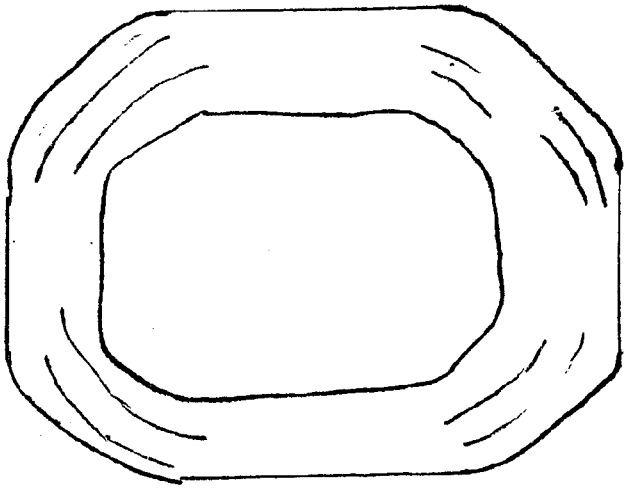
FIG. 10 is an embodiment of octagonal support structure for use in an embodiment of the invention.
Figure 11:
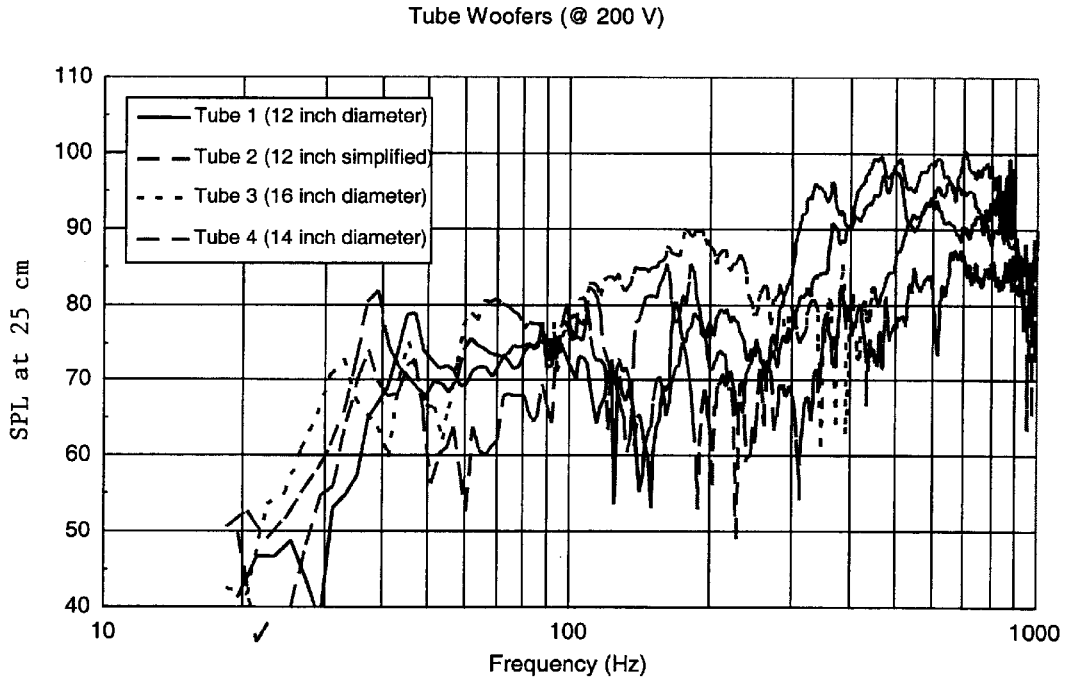
FIG. 11 is a graph illustrating test results for several alternative embodiments of the invention.

It is clear that many other embodiments employing these principles will also effectively provide low frequency acoustic projection. For example, the support structure can take various non-circular shapes. Tests show that inflatable rubber tubes formed into square shapes and octagonal shapes with slightly rounded corners, as shown in FIGS. 10 and 11, were also effective.

Many other variations on the acoustic projector construction have been fabricated and tested. These include using different diaphragm material (i.e. mylar), different actuator support material ("Sturdiboard" paper-faced styrafoam), and different device dimensions (tube diameters and thickness). Test results for some configurations are shown in the graphs of FIG. 11. It can be seen that all the tested acoustic projectors performed very well at low frequencies.

Note that these devices are very lightweight. For example, a 15 inch diameter acoustic projector, manufactured with an inflatable rubber tube and lightweight actuator and backing material, was only 188 grams.

Figure 12:
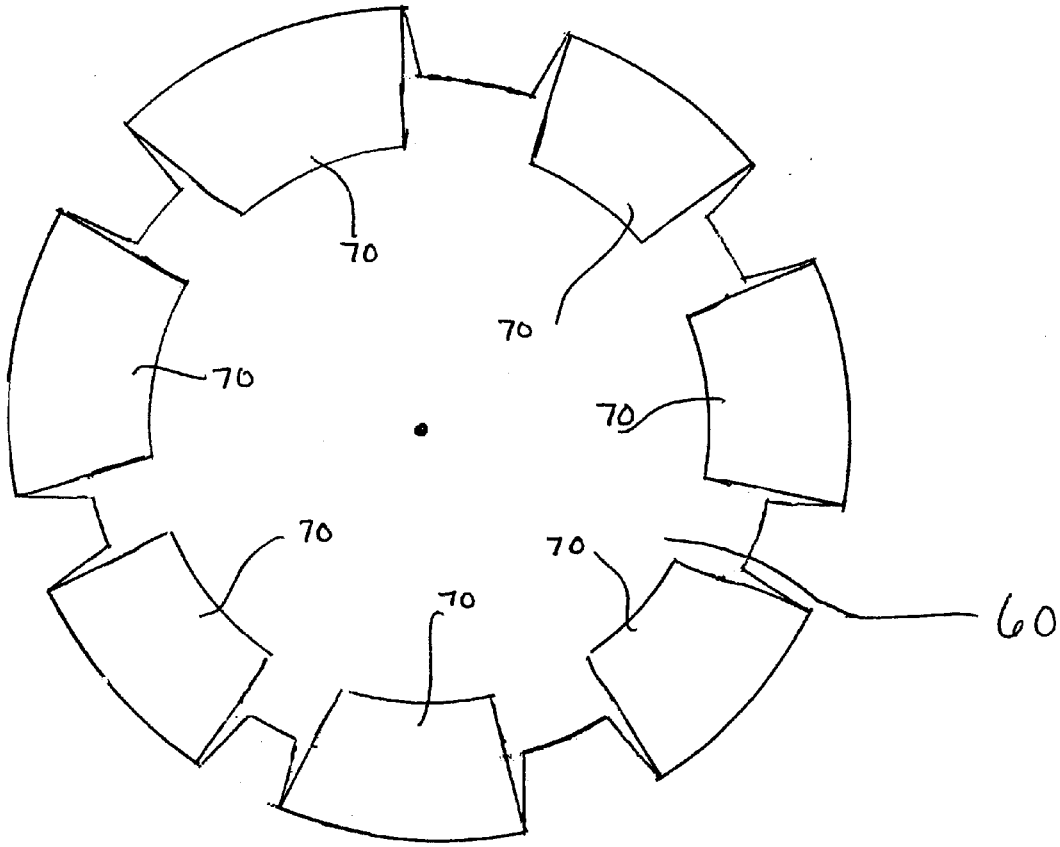
FIG. 12 is a top plan view of another alternative support structure for use in an embodiment of the invention.
Figure 13:
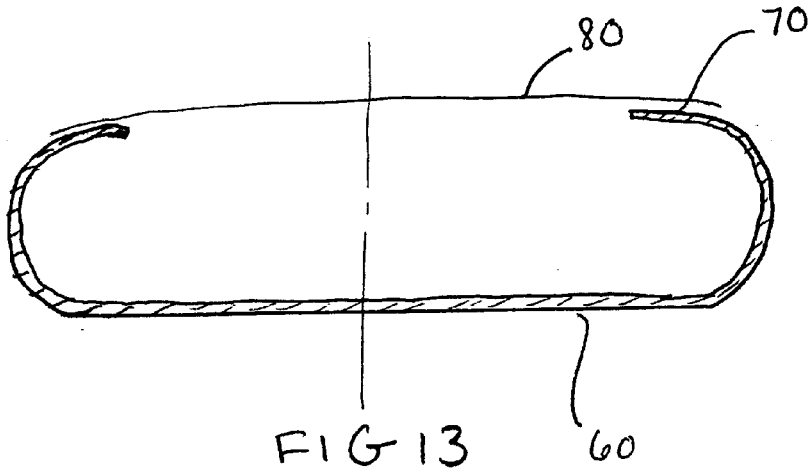
FIG. 13 is a cross sectional view of the alternative support structure of FIG. 12.
Figure 14:
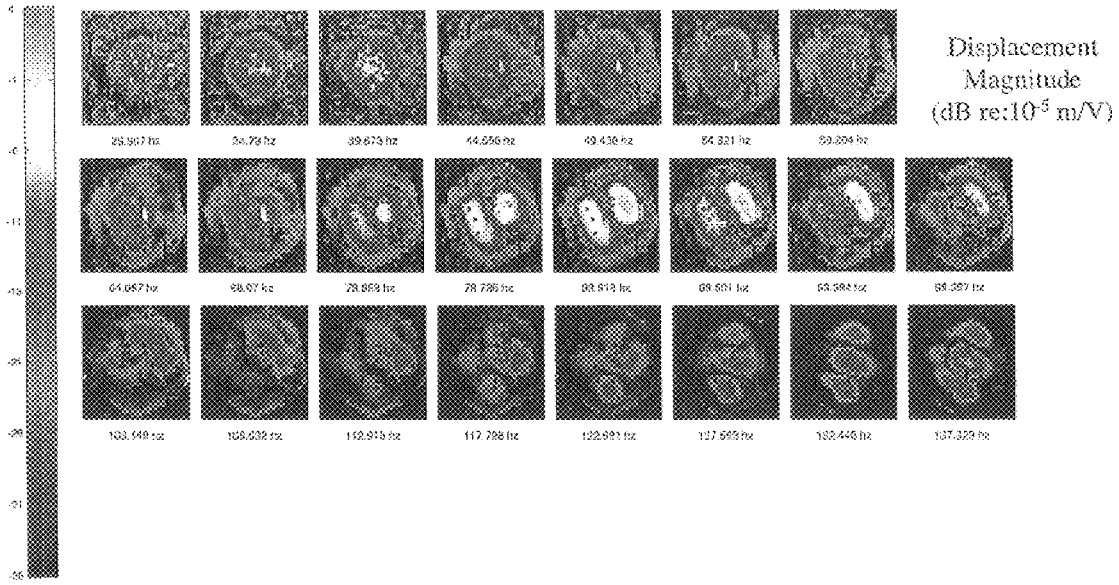
FIG. 14 is a black and white series of surface displacement maps for an embodiment of the invention over a frequency range corresponding to FIG. 7.
Figure 15:
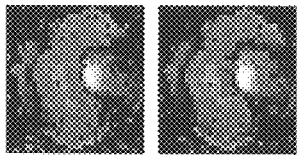
FIG. 15 is black and white series of surface displacement maps illustrating the effects of flexural motion of the support ring on diaphragm surface displacement corresponding to FIG. 8.
Figure 15:
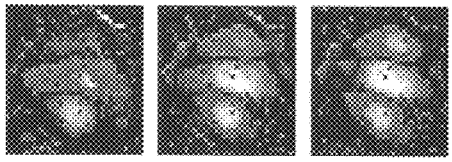
Figure 15:
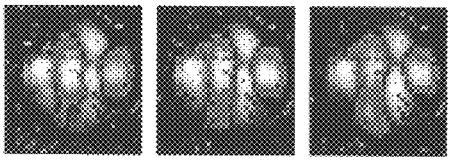

Another embodiment of a support structure which may be used in this invention is shown in FIGS. 12 and 13. The support structure 60 is constructed of thin metal or other stiff material, with ribs 70 which are generally coplanar with the diaphragm 80 and which extend in radial direction toward the central region. The diaphragm 80 is adhesively attached to the ribs 70. The metal ribs 70 are sufficiently flexible in the axial direction to allow the diaphragm 80 and ribs 70 to move up and down together in response to application of a displacement of the membrane by an actuator. This creates the soft boundary conditions necessary for good low frequency performance. This type of support structure generally does not the exhibit all of the plate-like flexural modes discussed above and illustrated in FIG. 8.

In another embodiment of the invention (not shown), a convention stiff hoop-shaped frame was covered with a layer of the compliant material felt. The diaphragm material was a heat-shrinkable polyvinyl chloride (PVC) membrane. The PVC membrane was placed across and around the support structure and was heat-shrunk in place so the membrane formed an acoustic diaphragm in tension. Because the felt covered frame was relatively compliant, the diaphragm's boundary condition was soft compared to the stretching stiffness of the acoustic diaphragm. Test results show this embodiment produced good low frequency results similar to those described above in other embodiments of the invention. Because of the stiffness of the frame, this embodiment also did not the exhibit all of the plate-like flexural modes discussed above.

In other embodiments, multiple acoustic actuator devices, operated as an array, can be used to produce higher output levels. For example, two units can be stacked with reverse orientations or polarity to form a dynamic-volume device. While the output of each is reduced at frequencies where the separation distance results in partial cancellation, at other frequencies the two outputs add.

In other embodiments, the actuator end in contact with the acoustic diaphragm may be adhesively attached to the diaphragm.

In other embodiments, other actuator elements can be used, including low-force voice coils and electrostrictive actuators.

The outer edge of the acoustic diaphragm may be attached to the support structure by many different means, including by adhering the diaphragm to the support structure with an adhesive, or by heat shrinking the diaphragm in place, or by other mechanical means. The outer edge of the acoustic diaphragm may also be clamped to the compliant support structure.

The above embodiments are provided for illustration of the invention. Many different embodiments within the scope of this invention will be clear to those of skill in the art. Reference should be made to the appended claims for the scope of the invention described herein.

What is claimed is:

1. An acoustic projector, comprising:

an acoustic diaphragm comprising a flexible membrane; and a support structure for securing the diaphragm thereto; wherein said support structure has a size and configuration and is positioned so as to maintain the diaphragm in tension in a radial direction, and wherein the support structure has less stiffness in an axial direction than the stretching stiffness of the acoustic diaphragm.

2. An acoustic projector as in claim 1, wherein the acoustic diaphragm is a polymer membrane.

3. An acoustic projector as in claim 2, wherein the polymer membrane is heat-shrinkable.

4. An acoustic projector as in claim 2, wherein the acoustic membrane is Mylar, polyethylene, Kaptan, polyvinyl chloride, or polystyrene.

5. An acoustic projector as in claim 1, wherein the support structure is a toroidally shaped inflatable rubber tube.

6. An acoustic projector as in claim 5, wherein the toroidally shaped inflatable rubber tube is inflated sufficiently to hold the acoustic diaphragm in tension.

7. An acoustic projector as in claim 6, wherein the inflated rubber tube has a polygonal configuration.

8. An acoustic projector as in claim 6, wherein the inflated rubber tube has a square configuration.

9. An acoustic projector as in claim 6, wherein the inflated.rubber tube has an octagonal configuration.

10. An acoustic projector as in claim 2, wherein the support structure includes a perimeter; the polymer membrane is positioned on the support structure and extends beyond the outer perimeter of the support structure, and the polymer membrane is stretched sufficiently to place the polymer membrane in tension.

11. An acoustic projector as in claim 1, further comprising means for converting between electrical signals and acoustic diaphragm motion.

12. An acoustic projector as in claim 11, wherein the converting means includes a piezoelectric actuator having a portion contacting a face of the acoustic diaphragm, wherein upon application of a voltage to the piezoelectric actuator, the piezoelectric actuator causes displacement of the acoustic diaphragm in an axial direction.

13. An acoustic projector as in claim 12, wherein the piezoelectric actuator is a bender-type actuator having a first end in contact with a face of the acoustic diaphragm, and a second end attached to a backing for substantially limiting movement of said second end.

14. An acoustic projector as in claim 13, further comprising a pad attached to an end of the bender type actuator, the pad being disposed between the acoustic diaphragm and the bender type actuator.

15. An acoustic projector as in claim 14, wherein the pad is felt.

16. An acoustic projector as in claim 1, wherein the support structure comprises a stiff frame and a compliant material, the compliant material being disposed between the acoustic diaphragm and the stiff frame and in contact with the acoustic diaphragm.

17. An acoustic projector as in claim 16, wherein the compliant material is felt.

18. An acoustic projector as in claim 1, wherein the support structure has a plurality of ribs coplanar with the acoustic diaphragm, the ribs extending in an axial direction toward the center of the acoustic diaphragm, and wherein the acoustic diaphragm is attached at its perimeter to the ribs.

19. An acoustic projector as in claim 18, wherein the acoustic diaphragm is adhesively attached to the ribs.

20. An acoustic projector, comprising:

an acoustic diaphragm comprising a flexible polymer membrane; and a support structure for securing the diaphragm thereto; wherein said support structure has a size and configuration and is positioned so as to maintain the diaphragm in tension in a radial direction, and wherein the support structure has less stiffness in an axial direction than the stretching stiffness of the acoustic diaphragm.

21. An acoustic projector, comprising:

an acoustic diaphragm comprising a polymer membrane;

a support structure for securing the diaphragm thereto, wherein said support structure has a size and configuration and is positioned so as to maintain the diaphragm in tension in a radial direction and wherein the support structure has less stiffness in an axial direction than the stretching stiffness of the acoustic diaphragm;

and a piezoelectric actuator having a portion contacting a face of the acoustic diaphragm, wherein upon application of a voltage to the piezoelectric actuator, the piezoelectric actuator causes displacement of the acoustic diaphragm in an axial direction.

* * * * *